US005125921A

United States Patent [19]

Duschek

[11] Patent Number: 5,125,921

[45] Date of Patent: Jun. 30, 1992

[54] CLOSURE ARRANGEMENT FOR PHARMACEUTICAL BOTTLES

[75] Inventor: Dieter Duschek, Allensbach, Fed. Rep. of Germany

[73] Assignee: Wez Kunststoffwerk AG, Oberentfelden, Switzerland

[21] Appl. No.: 459,782

[22] PCT Filed: Jun. 21, 1989

[86] PCT No.: PCT/CH89/00116

§ 371 Date: Jan. 26, 1990

§ 102(e) Date: Jan. 26, 1990

[87] PCT Pub. No.: WO90/00141

PCT Pub. Date: Jan. 11, 1990

[30] Foreign Application Priority Data

Jun. 28, 1988 [DE] Fed. Rep. of Germany ..... 3821674
Jan. 30, 1989 [DE] Fed. Rep. of Germany ..... 3902672

[51] Int. Cl.[5] ..... B65D 41/32

[52] U.S. Cl. ..... 604/415; 604/416; 215/247

[58] Field of Search ..... 604/415, 416; 215/247, 215/249

[56] References Cited

U.S. PATENT DOCUMENTS 4,089,432 5/1978 Crankshawet et al. ..... 604/45 X
4,463,862 8/1984 Hanson ..... 604/415 X
4,465,200 8/1984 Percarpio ..... 604/415 X
4,592,092 5/1986 McPhee ..... 604/415 X
4,632,673 12/1986 Tiitola et al. ..... 604/415
4,834,152 5/1989 Howson et al. ..... 604/416 X
4,863,453 9/1989 Berger ..... 604/415

FOREIGN PATENT DOCUMENTS 1207043 12/1965 Fed. Rep. of Germany .
0160626 11/1985 Italy .

*Primary Examiner*—Robert A. Hafer
*Assistant Examiner*—Kerry Owens
*Attorney, Agent, or Firm*—Sandler, Greenblum, & Bernstein

[57] ABSTRACT

A closure arrangement for pharmaceutical bottles contains a stopper closing the bottle mouth, and a closure cap mounted over the bottle mouth and a closure cap. The stopper is adapted to be pierced with a hollow needle for extracting a medicament located in the bottle. The closure cap is provided with a tear-off disc which is located above the stopper and is removable upon opening the closure. The tear-off disc is produced from plastic material in one piece with the closure cap and is retained thereat by means of a weakening line. Between the tear-off disc and the stopper there is provided a spacer which does not extend beyond the outline of the tear-off disc. The spacer is formed in one piece with the tear-off disc and/or with the stopper. The closure cap can be one-handedly pressed in the direction toward the bottle, whereby the tear-off disc is separated from the closure cap and the stopper is free for insertion of a hollow needle.

21 Claims, 1 Drawing Sheet

CLOSURE ARRANGEMENT FOR PHARMACEUTICAL BOTTLES

BACKGROUND OF THE INVENTION

1. Field of the Invention

The present invention relates to a closure arrangement for pharmaceutical bottles, which closure arrangement comprises a stopper which closes the bottle mouth and can be pierced by means of a hollow needle for extracting medicaments from the bottle, and a closure cap enclosing a welt ring, formed at the bottle around the bottle mouth, and the stopper, and which closure cap comprises a tear-off disc which is located above the stopper, limited by a weakening line and removable upon opening the closure.

2. Description of Background and Revelant Information

A closure arrangement of the above-mentioned type is known from German Patent No. 1,207,043. This closure arrangement consists of a combination of a cap which is mounted at the bottle, and of a rubber stopper which pierceably closes the pharmaceutical bottle. The cap comprises an upper structural member with an inner part and with an outer part. The inner and outer parts are connected with each other by breakable bridge parts. The inner part is connected to a cover member which can be pressed away from the bottle by means of thumb pressure, in order to thereby fracture the bridge parts and to release and remove the inner part of the cap from the outer part. The rubber stopper beneath the inner part of the cap is thereupon free to be pierced by a hollow needle. A disadvantage of this closure arrangement is seen in the fact that the cover member must be removed from the bottle by thumb pressure, whereby the root portion of the finger-nail is undesirably strained. Furthermore, there exists the risk of injury at the locations of fracture of the bridge parts formed of metal. A further economical disadvantage is thereby given in that too many components are required for the closure arrangement, namely a part which is flangeable onto the bottle, a cover member connected therewith and a rubber stopper. For flanging the cap onto the bottle and for the connection of the inner part with the cover member there are required complicated special devices. The production costs of the cap components made of metal are also relatively high.

SUMMARY OF THE INVENTION

The object of the present invention is to provide a closure arrangement of the above-mentioned type which is economically advantageous and in which the tear-off disc can be one-handedly removed in a safe, convenient and rapid manner.

This object is achieved in that the closure cap is formed of plastic material in one piece with the tear-off disc, that the closure cap in the unopened condition of the closure is mounted at the welt ring of the bottle to be displaceable by pressing in the direction toward the bottle, and that a spacer is provided between the tear-off disc retained by means of the weakening line at the closure cap of the unopened closure, and the stopper located therebelow, such spacer not extending beyond the outline of the tear-off disc. This closure arrangement is economically advantageous. For example, the closure cap together with the tear-off disc is economically produced, advantageously from plastic material, in a one-step process. The closure cap, with the closure in the unopened condition, can be safely and conveniently one-handedly pressed upon the bottle in the direction toward the bottle. The tear-off disc is thereby separated from the closure cap and clears the stopper for the extraction of a medicament located in the bottle by means of a hollow needle which can be pierced through the stopper. With this closure cap there is no risk of injury.

The spacer can be advantageously formed in one piece with the tear-off disc and/or with the stopper. This measure renders possible that the closure arrangement consists only of two economically advantageous components, namely of the closure cap and of the stopper.

The spacer can be formed in one piece with the tear-off disc, and the end of the tear-off disc, such end facing the stopper, can thereby sealingly engage the stopper when the closure is unopened. This measure ensures that the surface of the stopper, which surface is provided for the extraction of a medicament located in the bottle, remains protected from impurities prior to removal of the tear-off disc.

However, the tear-off disc can also be formed in one piece with the stopper, and the end of the stopper, such end facing the tear-off disc, can thereby sealingly engage the tear-off disc when the closure is still unopened. In this arrangement there is prevented, prior to removal of the tear-off disc, the infiltration of impurities to the surface of the stopper, which surface is provided for the extraction of the medicament located in the bottle by means of a hollow needle.

The closure cap advantageously widens from the weakening line in a funnel-shaped manner in the direction away from the bottle. The handling of the closure cap is thereby facilitated because, upon pressing the closure cap, the tear-off disc separating from the closure cap does not obstruct the pressing operation. The tear-off disc remains in the rear of the funnel-shaped portion of the closure cap.

The closure cap can comprise, at the inner side of its outer jacket region which extends beyond the welt ring, an annular latching bead which, with the closure unopened, grippingly engages on the rear of the edge of the welt ring and which edge is remote from the bottle mouth. The latching bead thus retains the unopened closure cap in simple manner at the bottle and renders possible simple mounting of the closure cap at the bottle.

The closure cap can also comprise a second annular bead at the inner side of its outer jacket region extending beyond the welt ring. This second bead retains the pressed-in opened closure cap in this position.

In order to be able to retain the stopper in the bottle mouth by the portions of the closure cap, which portions surround the tear-off disc, when the closure is in the unopened as well as in the open condition thereof, the spacer can be formed in one piece with the tear-off disc, whereby the end of the tear-off disc, such end facing the stopper, sealingly engages the stopper when the closure is unopened and the spacing between the latching bead and the second bead corresponds to the shortest distance between the portions of the closure cap, such portions surrounding the tear-off disc, and the stopper, when the closure is unopened.

In order to be able to retain the stopper in the bottle mouth by the portions of the closure cap, which portions surround the tear-off disc, when the closure is in the unopened as well as in the open condition thereof, the spacer can also be formed in one piece with the stopper, whereby the end of the stopper, such end facing the tear-off disc, sealingly engages the tear-off disc when the closure is unopened and the spacing between the latching bead and the second bead corresponds to the shortest distance between the portions of the closure cap, such portions surrounding the tear-off disc, and the stopper, when the closure is unopened.

The spacing between the latching bead and the second bead can correspond to the width of the welt ring. With this spacing between the two beads, the closure cap is more securely seated at the bottle when the closure is unopened.

BRIEF DESCRIPTION OF THE DRAWINGS

Exemplary embodiments of the invention are hereinafter described in greater detail in conjunction with the annexed drawings.

DETAILED DESCRIPTION OF THE PREFERRED EMBODIMENTS

Figure 1:
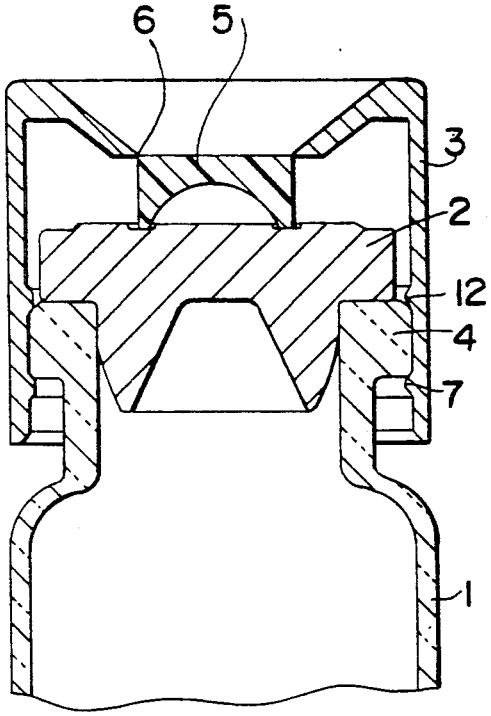
FIG. 1 illustrates, partially in section, a pharmaceutical bottle with unopened closure.
Figure 2:
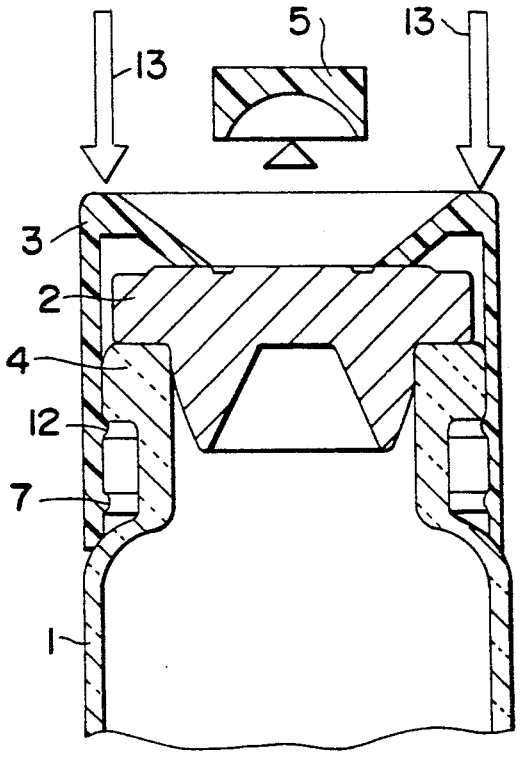
FIG. 2 illustrates the bottle of FIG. 1 with opened closure.

FIG. 1 shows a closure arrangement for a pharmaceutical bottle 1 which can be, for example, an injection bottle or a transfusion bottle. The bottle 1 is closed by a stopper 2 made of rubber and inserted in the bottle mouth. The stopper can be pierced by means of a hollow needle and the medicament located in the bottle 1 can be extracted from the bottle 1 by the hollow needle. The stopper 2 is externally enclosed and protected by a closure cap 3. However, the closure cap 3 also surrounds a welt ring 4 formed at the bottle 1 around the bottle mouth. Above the stopper 2 there is located a tear-off disc 5 which, prior to opening the closure, is integrally connected to the closure cap 3 by means of a weakening line 6. The closure cap 3 and the tear-off disc 5 consist of plastic material, of polypropylene.

Thus, the closure cap 3 includes a first portion having an interior surface adapted to extend around the bottle mouth and around the stopper 2 when the stopper is inserted within the bottle mouth, and a second portion including the tear-off disc 5 adapted to be positioned proximate a portion of the stopper 2 remote from the bottle mouth. The tear-off disc 5 is formed unitarily with the closure cap 3 and is delimited with respect to the first portion of the closure cap by the weakening line 6.

The closure cap 3, with the closure unopened according to FIG. 1, is mounted at the welt ring 4 to be displaceable by pressing in the direction toward the bottle 1. At the top, the end of the tear-off disc 5, which end faces the stopper 2 and which tear-off disc 5 can be separated from the closure cap 3 by pressing, sealingly bears upon the stopper 2. By this measure there is prevented, prior to opening the bottle, contamination of the portion of the stopper 2 provided to be pierced. The annular latching bead 7 located behind, or below, an edge of the welt ring 4 and which edge is remote from the bottle mouth, secures the closure cap 3 at the bottle 1 in the direction away from the bottle. In view of the configuration of the closure arrangement, the tear-off disc 5 is removable from the remainder of the closure arrangement upon rupture of the weakening line 6, and the first portion of the closure cap 3 is displaceable with respect to the second portion of the closure portion in a direction toward the bottle 1 between an upper, unopened position, wherein the first portion is spaced from the stopper 2, and a lower, openable position, upon the rupture of the weakening line 6.

Between the tear-off disc 5, retained at the closure cap 3 by means of the weakening line 6 when the closure is unopened, and the stopper 2 located therebelow, there is provided a spacer which does not extend beyond the outline of the tear-off disc 5. The spacer must not exceed the outline of the tear-off disc 5, in order that the spacer can slip through the aperture resulting in the closure cap 3 subsequent to removal of the tear-off disc 5. In the arrangement according to FIG. 1, the spacer is formed in one piece with the tear-off disc 5.

Figure 3:
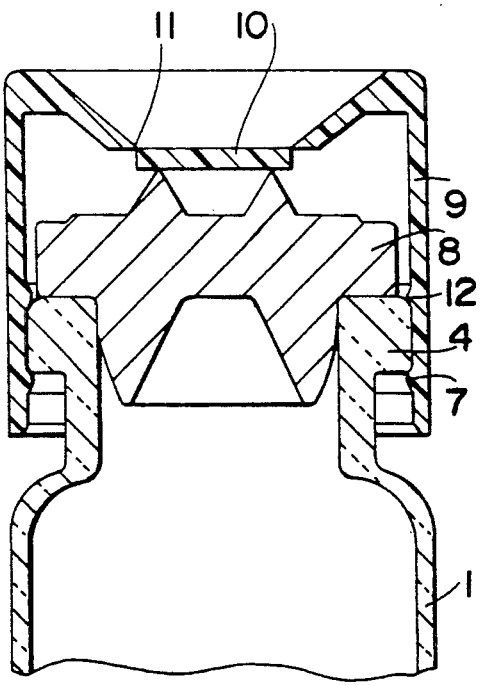
FIG. 3 illustrates, partially in section, a further pharmaceutical bottle with unopened closure.
Figure 4:
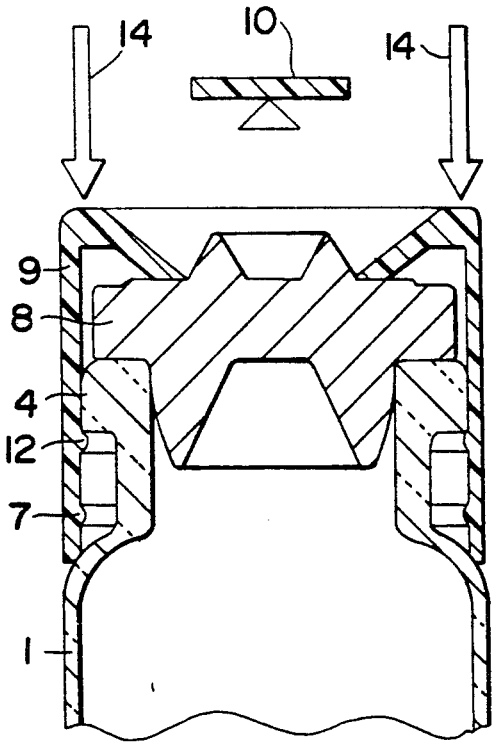
FIG. 4 illustrates the bottle of FIG. 3 with opened closure.

In FIGS. 3 and 4 there is illustrated a further closure arrangement with the bottle 1. In this arrangement, the bottle 1 is likewise closed by a pierceable stopper 8 made of rubber. When the closure is still unopened, a closure cap 9 surrounds the welt ring 4 formed around the bottle mouth, and the stopper 8. The closure cap 9 is secured at the bottle 1 by the latching bead 7, located at the interior surface of the closure cap grippingly engaging on the rear, or lower edge, of the welt ring 4. In this arrangement with the closure unopened, the spacer located between the tear-off disc 10 and the stopper 8 is formed in one piece with the stopper 8. However, it would also be possible to form the spacer to be part of the tear-off disc and part of the stopper. or to form the spacer to be independent of both. As depicted in FIG. 3, the extension of the stopper 8, such extension serving as a spacer, sealingly bears upon the tear-off disc 10 and prevents a possible contamination of the portion of the stopper 8, which portion is provided to be pierced. The tear-off disc 10 and the closure cap 9 are formed in one piece of plastic material. With the closure unopened, the tear-off disc 10 covering the stopper 8 is retained, as depicted in FIG. 3, at the closure cap 9 by means of the weakening line 11.

The closure caps 3 and 9 depicted in FIGS. 1 through 4 widen in funnel-shaped manner from the respective weakening lines 6 and 11 in the direction away from the bottle 1. The closure caps 3 and 9 comprise a second annular bead at the inner side of their outer jacket region extending beyond the welt ring 4. With the closure unopened according to FIGS. 1 and 3, respectively, the spacing between the annular latching bead 7 and the second, upper, bead 12 corresponds, in all Figures, with the shortest distance between the portions of respective closure caps 3 and 9 such portions surrounding respective tear-off discs 5 and 10, and the associated stoppers 2 and 8, respectively. Furthermore, the spacing between the latching bead 7 and the second bead 12 corresponds with the width of the welt ring 4. The closure caps 3 and 9, with the closure unopened, are supported in the direction toward the bottle 1 not only at the respective stoppers 2 and 8, but also by means of the second bead 12 at the edge of the welt ring 4, which edge faces the bottle mouth.

The mode of operation of the illustrated closure arrangements is hereinafter described. If the stopper 2 of the bottle with the closure unopened and depicted in FIG. 1 is to be cleared for the insertion of a not illustrated hollow needle, then one presses the closure cap 3 with one's thumb as indicated by the arrows 13 in FIG. 2. One can also press the closure cap 3 against a firm object while holding the bottle in one hand. When the pressure is sufficiently great, the connection between the closure cap 3 and the tear-off disc 5 fractures along the weakening line 6. The tear-off disc 5 therewith moves into the funnel-shaped extension of the closure cap 3 and bears upon the adjacent pressing surface as viewed in the direction of the arrows 13 after separation from the closure cap 3. Subsequent to removal of the tear-off disc 5 with one hand, the bottle 1 is ready for the extraction of a medicament located in the bottle 1 by means of a hollow needle. The closure cap 3 thereby firmly retains the stopper 2 in the bottle mouth, because subsequent to the pressing-in of the closure cap 3, on the one hand, the second bead 12 grippingly engages on the rear of the edge of the welt ring 4 and which edge is remote from the bottle mouth, and latches in there and, on the other hand, the portions of the closure cap 3, such portions surrounding the tear-off disc 5, bear upon the stopper 2.

The opening process of the bottle 1 depicted in FIG. 3 and provided with a closure is accomplished in a similar manner. One presses the closure cap 9 in the direction indicated by the arrows 14 in FIG. 4 until the tear-off disc 10 separates at the weakening line 11 from the closure cap 9. The extension of the stopper 8, which extension serves as a spacer, projects thereupon through the aperture cleared in the closure cap 9. Subsequently, the stopper 8 can be pierced with a hollow needle and the medicament located in the bottle 1 can be extracted. The stopper 8 is thereby secured in the bottle mouth by the portions of the closure cap 9 engaging thereat, because the closure cap, in turn, is retained at the bottle 1 by the second bead 12 latching behind the welt ring 4.

What is claimed is:

1. A closure arrangement for pharmaceutical bottles comprising:

a stopper for insertion into a bottle mouth, said stopper being adapted to be pierced by means of a hollow needle for extracting medicaments from said bottle; and a closure cap being formed of a plastic material, said closure cap comprising:

(i) a first portion having an interior surface adapted to extend around said bottle mouth and around said stopper when said stopper is positioned within said bottle mouth; and (ii) a second portion comprising a tear-off disc adapted to be positioned proximate a portion of said stopper remote from said bottle mouth, said tear-off disc being formed unitarily with said closure cap and being delimited with respect to said first portion of said closure cap by a weakening line, said tear-off disc being removable from said closure arrangement upon rupture of said weakening line;

said first portion of said closure cap being displaceable with respect to said second portion in a direction toward said bottle between (1) an unopened position, wherein said first portion is spaced from said portion of said stopper, and (2) an openable position, upon said rupture of said weakening line.

2. The closure arrangement of claim 1, first portion of said closure cap having an opening having a periphery defined at said weakening line, upon said rupture of said weakening line, said closure arrangement further comprising a spacer not extending beyond said weakening line, whereby said periphery of said opening of said first portion of said closure cap is movable adjacent said spacer during displacement of said first portion from said upper, unopened position to said lower, openable position.

3. The closure arrangement of claim 2, said spacer being unitary with said tear-off disc.

4. The closure arrangement of claim 3, said spacer being in sealing engagement with said stopper in said unopened position of said first portion of said closure cap.

5. The closure arrangement of claim 2, said spacer being unitary with said stopper.

6. The closure arrangement of claim 5, said tear-off disc being in sealing engagement with said stopper in said unopened position of said first portion of said closure cap.

7. The closure arrangement of claim 2, said spacer being unitary with said tear-off disc and being unitary with said stopper.

8. The closure arrangement of claim 1, said closure cap widening in a funnel-shaped manner in a direction away from said bottle.

9. The closure arrangement of claim 1, further comprising a first latching bead located at said interior surface of said first portion of said closure cap, said bottle mouth having an annular welt ring having a lower annular edge, said first latching bead being adapted to grippingly engage said lower annular edge of said welt ring in said unopened position of said first portion of said closure cap.

10. The closure arrangement of claim 9, further comprising a second latching bead located at said interior surface of said first portion of said closure cap, said second latching bead being spaced from said first latching bead, said annular welt ring having an upper annular edge, said second latching bead being adapted to grippingly engage said upper annular edge of said welt ring in said unopened position of said first portion of said closure cap.

11. The closure arrangement of claim 10, said spacer being unitary with said tear-off disc and in sealing engagement with said stopper in said unopened position of said first portion of said closure cap, wherein said weakening line is spaced from an upper portion of said stopper by a predeterminate amount, and wherein said first latching bead and said second latching bead are spaced apart by said predeterminate amount.

12. The closure arrangement of claim 10, said spacer being unitary with said stopper and in sealing engagement with said tear-off disc in said unopened position of said first portion of said closure cap, wherein said weakening line is spaced from an upper portion of said stopper by a predeterminate amount, and wherein said first latching bead and said second latching bead are spaced apart by said predeterminate amount.

13. The closure arrangement of claim 10, said upper annular edge of said welt ring and said lower annular edge of said welt ring being spaced apart by a predeterminate amount, and wherein said first latching bead and said second latching bead are spaced apart by said predeterminate amount.

14. A closure arrangement for sealing a bottle mouth, said closure arrangement comprising:

a stopper for insertion into said bottle mouth; and a closure cap comprising:

(i) a first portion having an interior surface adapted to extend around said bottle mouth and around said stopper when said stopper is positioned within said bottle mouth;

(ii) a second portion comprising a tear-off disc adapted to be positioned proximate said stopper remote from said bottle mouth, said tear-off disc being in sealing engagement with said stopper, said tear-off disc being formed unitarily with said closure cap and being delimited with respect to said first portion of said closure cap by a weakening line, said tear-off disc being removable from said closure arrangement upon rupture of said weakening line, thereby forming an opening in said closure cap; and (iii) means for spacing said weakening line from a portion of said stopper remote from said bottle mouth, said means for spacing being unitary with said stopper.

15. The closure arrangement of claim 14, said closure cap widening in a funnel-shaped manner in a direction away from said bottle mouth.

16. A closure arrangement for sealing a bottle mouth, said closure arrangement comprising:

a stopper for insertion into said bottle mouth;

a closure cap comprising:

(i) a first portion having an interior surface adapted to extend around said bottle mouth and around said stopper when said stopper is positioned within said bottle mouth;

(ii) a second portion comprising a tear-off disc adapted to be positioned proximate said stopper remote from said bottle mouth, said tear-off disc being formed unitarily with said closure cap and being delimited with respect to said first portion of said closure cap by a weakening line, said tear-off disc being removable from said closure arrangement upon rupture of said weakening line, thereby forming an opening in said closure cap; and (iii) means for spacing said weakening line from a portion of said stopper remote from said bottle mouth;

a first latching bead located at said interior surface of said first portion of said closure cap, said bottle mouth having an annular welt ring having a lower annular edge, said first latching bead being adapted to grippingly engage said lower annular edge of said welt ring in an unopened position of said first portion of said closure cap.

17. The closure arrangement of claim 6, further comprising a second latching bead located at said interior surface of said first portion of said closure cap, said second latching bead being spaced from said first latching bead, said annular welt ring having an upper annular edge, said second latching bead being adapted to grippingly engage said upper annular edge of said welt ring in said unopened position of said first portion of said closure cap.

18. The closure arrangement of claim 17, said means for spacing being unitary with said tear-off disc and in sealing engagement with said stopper in said unopened position of said first portion of said closure cap, wherein said weakening line is spaced from an upper portion of said stopper by a predeterminate amount, and wherein said first latching bead and said second latching bead are spaced apart by said predeterminate amount.

19. The closure arrangement of claim 17, said means for spacing being unitary with said stopper and in sealing engagement with said tear-off disc in said unopened position of said first portion of said closure cap, wherein said weakening line is spaced from an upper portion of said stopper by a predeterminate amount, and wherein said first latching bead and said second latching bead are spaced apart by said predeterminate amount.

20. The closure arrangement of claim 17, said upper annular edge of said welt ring and said lower annular edge of said welt ring being spaced apart by a predeterminate amount, and wherein said first latching bead and said second latching bead are spaced apart by said predeterminate amount.

21. A method of unsealing a bottle provided with a closure arrangement, in which the closure arrangement includes a stopper for positioning within a bottle mouth, said stopper being adapted to be pierced by means of a hollow needle for extracting contents within said bottle, and a closure cap being formed of a plastic material, said closure cap including (i) a first portion having an interior surface adapted to extend around said bottle mouth and around said stopper when said stopper is positioned within said bottle mouth and (ii) a second portion including a tear-off disc adapted to be positioned proximate a portion of said stopper remote from said bottle mouth for sealing said contents within said bottle, said tear-off disc being formed unitarily with said closure cap and being delimited with respect to said first portion of said closure cap by a weakening line, said tear-off disc being removable from said closure arrangement upon rupture of said weakening line, said method comprising the steps of:

pressing on said first portion of said closure cap;

breaking said weakening line by means of said step of pressing;

removing said tear-off disc from said closure cap, thereby exposing a portion of said stopper for being pierced by means of a hollow needle for extracting said contents from said bottle; and moving said first portion of said closure cap with respect to said second portion of said closure cap in a direction toward said bottle.

* * * * *